US010942012B2

(12) United States Patent
Sun et al.

(10) Patent No.: US 10,942,012 B2
(45) Date of Patent: Mar. 9, 2021

(54) CONDUCTED ELECTRICAL WEAPON

(71) Applicants: Jingbin Sun, Shenzhen (CN); Zhan'en Liao, Shenzhen (CN); Wenyu Su, Shenzhen (CN); Zhuoyue Sun, Shenzhen (CN)

(72) Inventors: Jingbin Sun, Shenzhen (CN); Zhan'en Liao, Shenzhen (CN); Wenyu Su, Shenzhen (CN); Zhuoyue Sun, Shenzhen (CN)

( * ) Notice: Subject to any disclaimer, the term of this patent is extended or adjusted under 35 U.S.C. 154(b) by 90 days.

(21) Appl. No.: 16/540,028

(22) Filed: Aug. 13, 2019

(65) Prior Publication Data

US 2020/0300584 A1 Sep. 24, 2020

(30) Foreign Application Priority Data

Mar. 24, 2019 (CN) ..... 201910224734.0
Mar. 24, 2019 (CN) ..... 201920374947.7

(51) Int. Cl.
*F41H 13/00* (2006.01)

(52) U.S. Cl.
CPC ..... *F41H 13/0025* (2013.01)

(58) Field of Classification Search
CPC ..... F41H 13/0025
See application file for complete search history.

(56) References Cited

U.S. PATENT DOCUMENTS 7,444,939 B2 * 11/2008 McNulty ..... F41H 13/0025 102/502
7,444,940 B2 * 11/2008 Kapeles ..... F41H 13/0025 102/502
8,857,305 B1 * 10/2014 Tseng ..... F41B 11/80 89/1.34
2006/0187610 A1 * 8/2006 Su ..... F41H 13/0025 361/232
2007/0086190 A1 * 4/2007 Kukuk ..... F41H 13/0018 362/253
2013/0208392 A1 * 8/2013 Brundula ..... H05C 1/06 361/232
2017/0160060 A1 * 6/2017 Purvis ..... F41H 13/0006
2017/0276461 A1 * 9/2017 Norris ..... F41H 13/0006
2019/0113308 A1 * 4/2019 Norris ..... F41G 1/35

* cited by examiner

*Primary Examiner* — Scott Bauer
(74) *Attorney, Agent, or Firm* — Matthias Scholl P.C.; Matthias Scholl

(57) ABSTRACT

A conducted electrical weapon includes a housing, a laser aiming mechanism, a catapult, and an ejection switch mechanism. The laser aiming mechanism is fixed on the chute of the housing. The catapult is embedded in the housing and the ejection switch mechanism is mounted inside the housing. The catapult includes an elastic clip including a first latch and a second latch. The housing includes a first slot and a second slot. The first latch and the second latch of the elastic clip separately catch the first slot and the second slot of the housing. The ejection switch mechanism includes an ejection switch including a first locating hole and a second locating hole, a first thrust spring, and a second thrust spring. The housing further includes a first locating column and a second locating column.

5 Claims, 11 Drawing Sheets

CONDUCTED ELECTRICAL WEAPON

CROSS-REFERENCE TO RELATED APPLICATIONS

Pursuant to 35 U.S.C. § 119 and the Paris Convention Treaty, this application claims foreign priority to Chinese Patent Application No. 201910224734.0 filed Mar. 24, 2019, and to Chinese Patent Application No. 201920374947.7 filed Mar. 24, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to the field of an antiriot devices, and more particularly to a non-lethal conducted electrical weapon that can fire a projectile to bind a target.

Conventional stun guns fire at a high speed that the impact can cause the target to fall to the ground instantly. However, this occasionally leads to unexpected deaths.

Conventional projectile devices have no binding function. As a result, the target can loosen or untie the ropes and then escape.

SUMMARY

The disclosure provides a conducted electrical weapon that can fire a projectile to bind a target. The conducted electrical weapon comprises a housing, a laser aiming mechanism, a catapult, and an ejection switch mechanism. The laser aiming mechanism is fixed on the chute of the housing, the catapult is embedded in the housing and the ejection switch mechanism is mounted inside the housing. The catapult comprises an elastic clip comprising a first latch and a second latch. The housing comprises a first slot and a second slot. The first latch and the second latch of the elastic clip separately catch the first slot and the second slot of the housing. The first latch and the second latch are simultaneously pressed to allow the catapult to be pulled out of the housing. The ejection switch mechanism comprises an ejection switch comprising a first locating hole and a second locating hole, a first thrust spring, and a second thrust spring. The housing further comprises a first locating column and a second locating column. The first thrust spring and the second thrust spring are butted against the first locating hole and the second locating hole and fixed on the first locating column and the second locating column, respectively. The laser aiming mechanism comprises a slide switch, a laser sight, a battery, and a circuit board. The laser sight and the battery are disposed on the circuit board and are fixed in the slide switch via screws.

The catapult comprises a first electric crochet, a second electric crochet, a cylinder with compressed gas, and a needle, and a ballistic body, a safety switch, a press block, and a door. The ballistic body comprises a first fixed area, a second fixed area, a third fixed area and a fourth fixed area. The first electric crochet, the second electric crochet, the cylinder, and the needle are separately mounted in the first fixed area, the second fixed area, the third fixed area and the fourth fixed area of the ballistic body. The elastic clip is pressed by the press block, and the ballistic body is locked by the safety switch and blocked by the door.

A wire is disposed between the first electric crochet and the second electric crochet. The high-voltage discharge is implemented by the battery, a control module, a boosting coil, the wire, a rectifying plate, a storage capacitor, a first crochet and a second crochet.

The cylinder with compressed gas, the needle, the first high-voltage crochet, and the second high-voltage crochet are fixed by the ballistic body. The elastic clip is loaded to the ballistic body to form the catapult; the included angle between the first electric crochet and the second electric crochet is 10 degrees.

DETAILED DESCRIPTIONS

To further illustrate, embodiments detailing a conducted electrical weapon are described below. It should be noted that the following embodiments are intended to describe and not to limit the disclosure.

Figure 1:
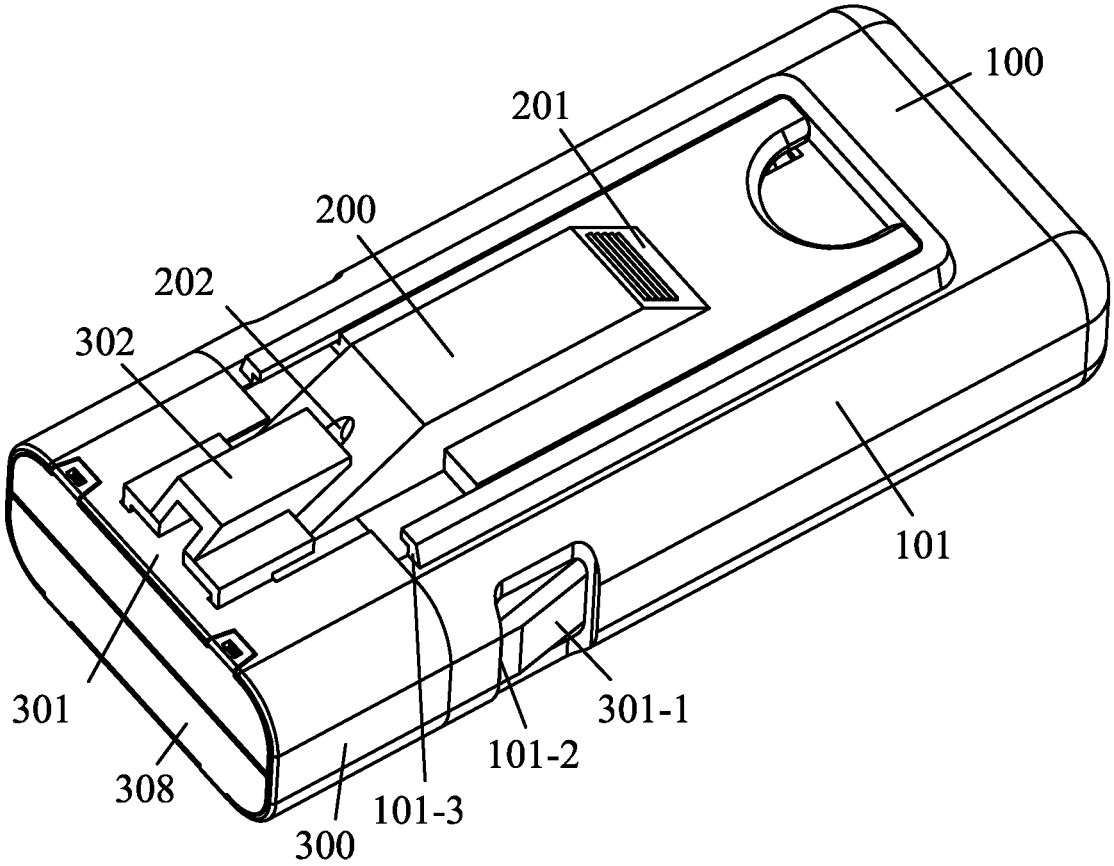
FIG. 1 is a schematic view of a conducted electrical weapon as described in the disclosure.

As shown in FIG. 1, the disclosure provides a non-lethal conducted electrical weapon that can fire a projectile to bind a target. The conducted electrical weapon has a binding function and comprises a housing 101, a laser aiming mechanism 200, a catapult 300, and an ejection switch mechanism 400 for controlling the launch of the catapult.

The laser aiming mechanism 200 is for aiming the target position and pushing away the safety switch of the catapult.

The catapult 300 is a device capable of fixing a pair of high-voltage crochet, providing kinetic energy and triggering mechanism that is for hooking and binding the target and discharging a high-voltage pulse current.

The ejection switch mechanism 400 is configured to control and drive the launch of the catapult.

The housing 101 is for protecting and fixing the above modules and mechanical components, and provides control, installation and implementation.

Figure 2A:
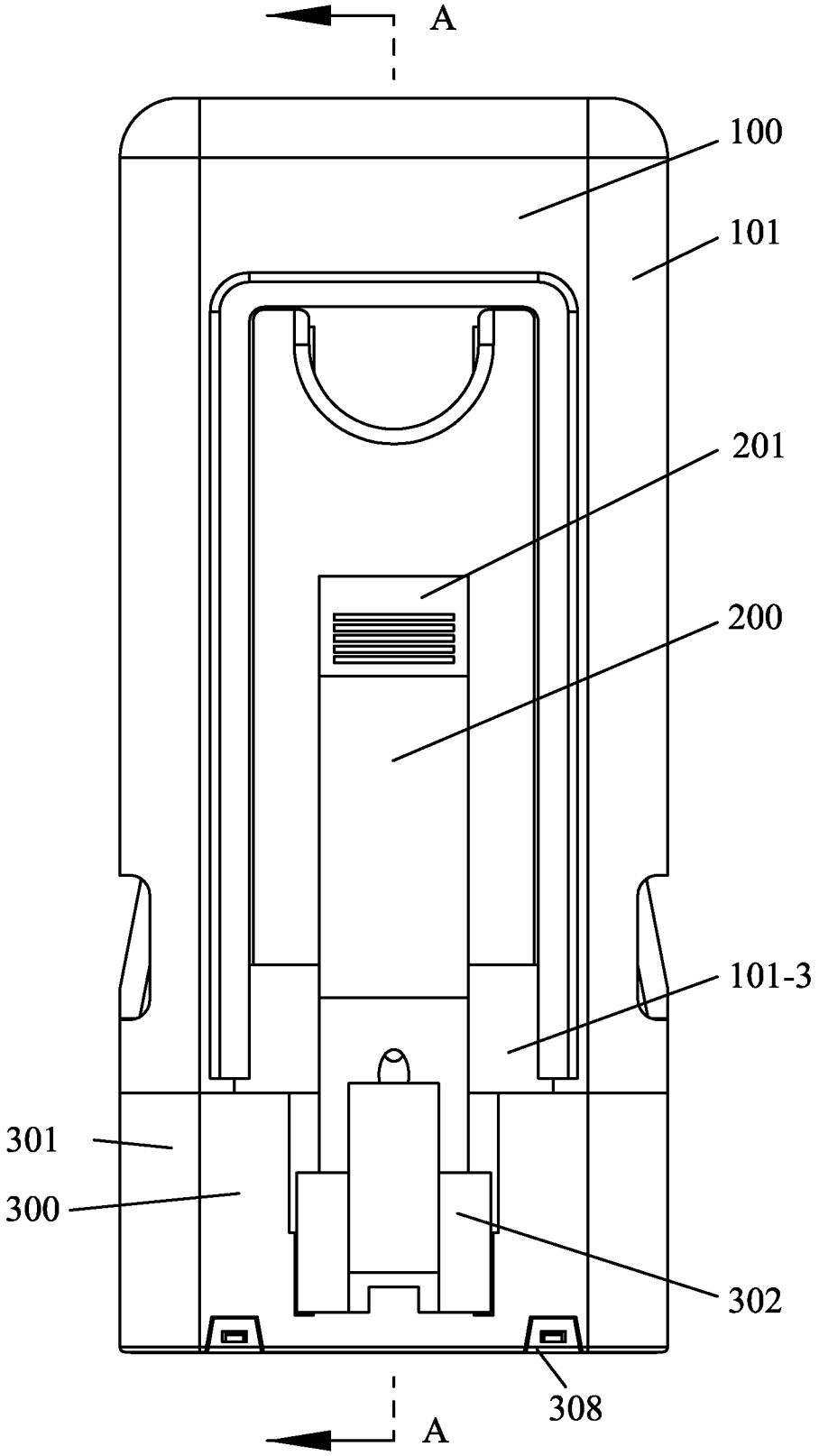
FIG. 2A is a top view of a conducted electrical weapon as described in the disclosure.
Figure 2B:
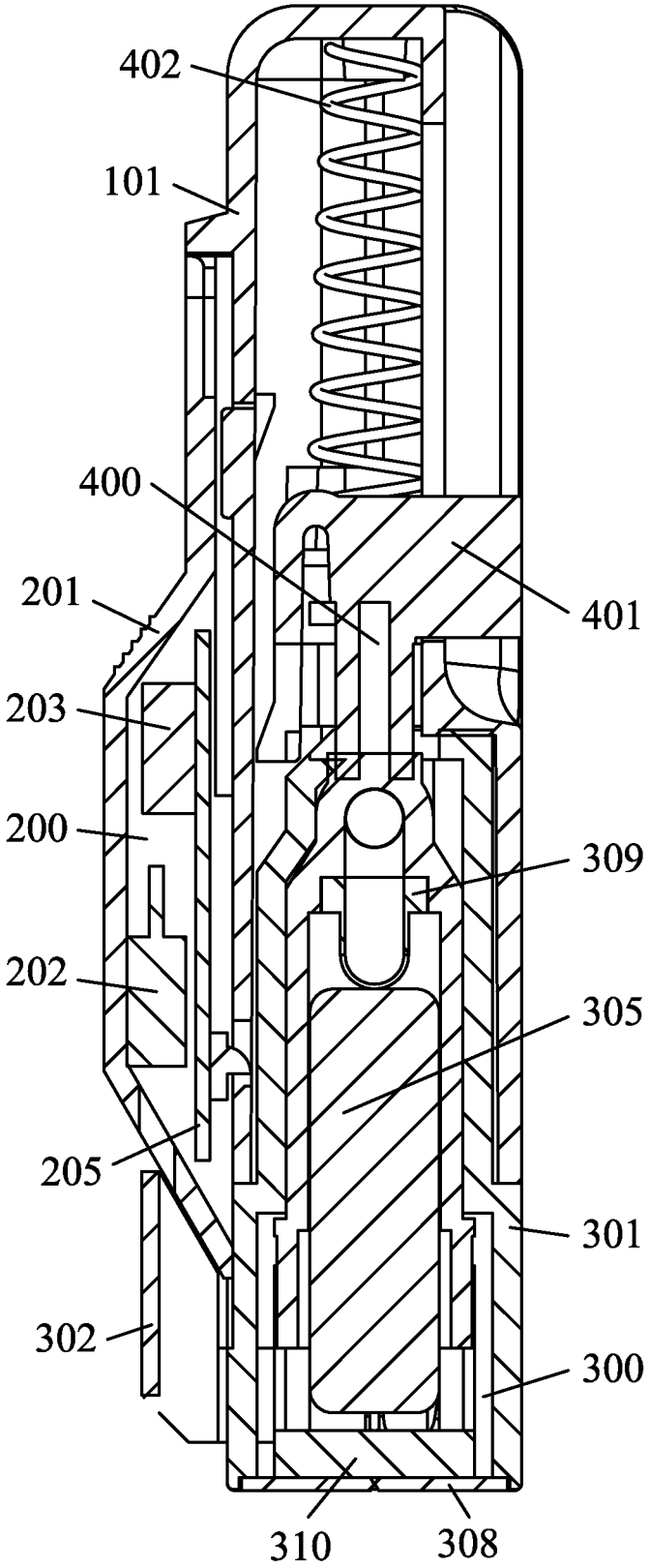
FIG. 2B is a cross-sectional view of a conducted electrical weapon as described in the disclosure.
Figure 3A:
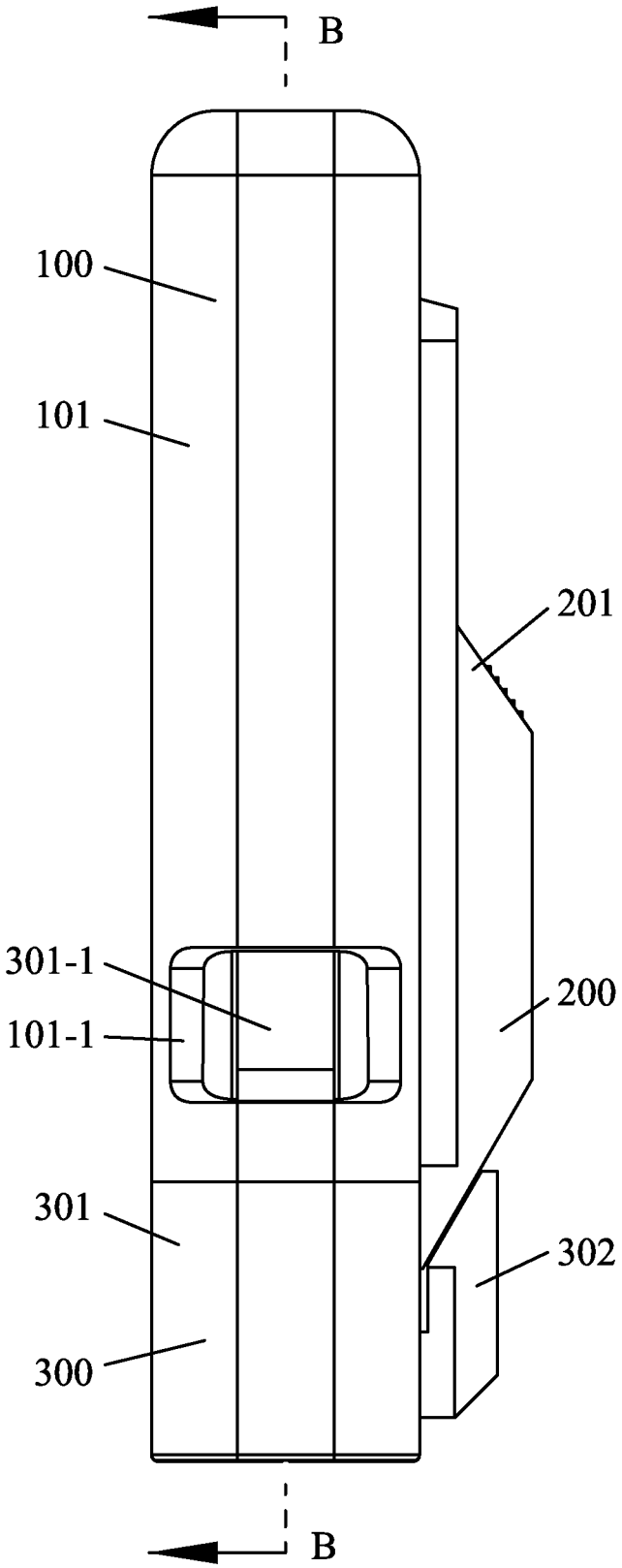
FIG. 3A is a left view of a conducted electrical weapon as described in the disclosure.
Figure 3B:
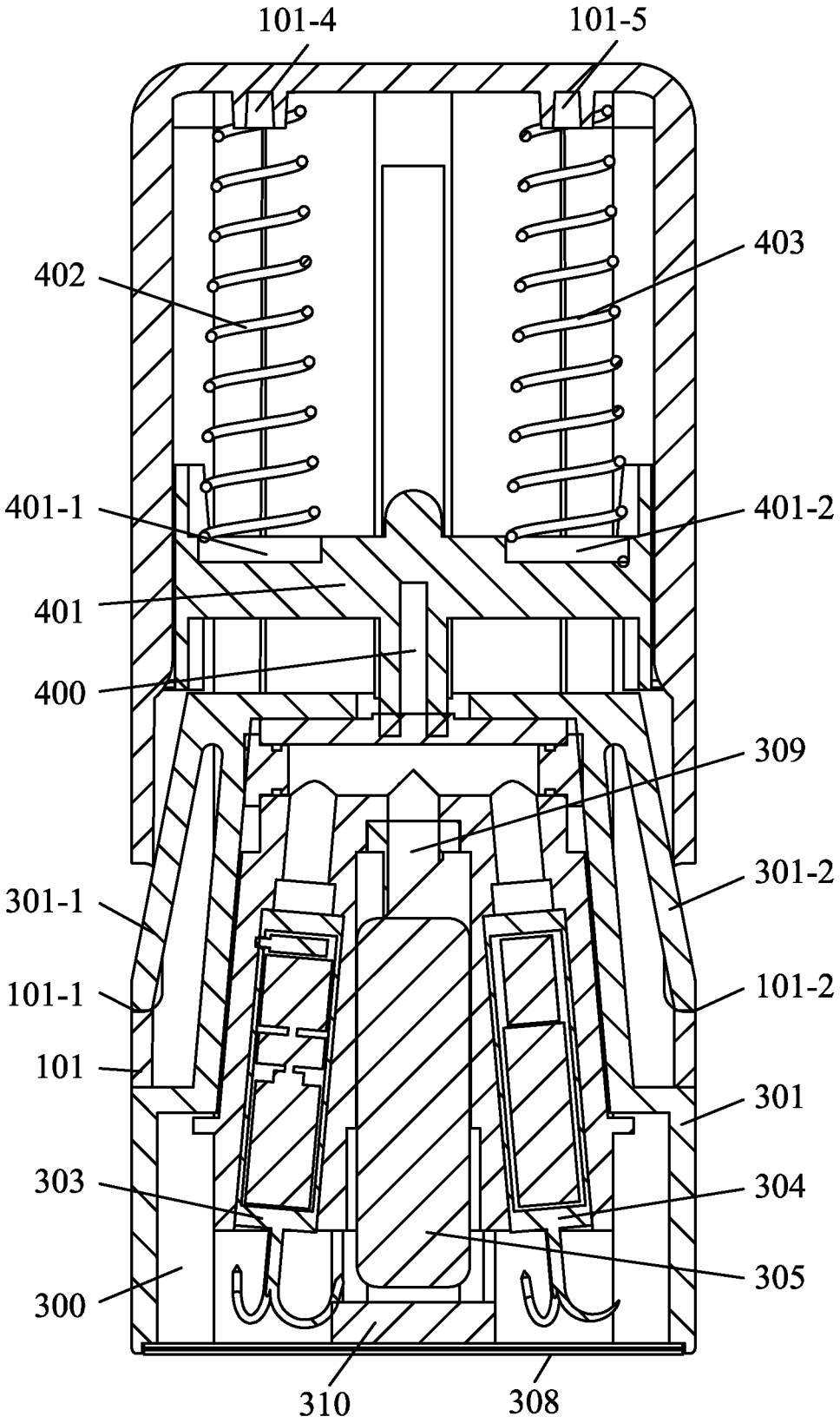
FIG. 3B is another cross-sectional view of a conducted electrical weapon as described in the disclosure.

The laser sight 202 and the battery 203 of the laser aiming mechanism 200 pass through the circuit board 205 and are fixed into the slide switch 201 (FIGS. 3A-3B). The slide switch 201 is fixed in the chute 101-3 of the housing 101. The catapult 300 is embedded in the housing 101, until the first latch 301-1 and the second latch 301-2 of the elastic clip 301 catch the first slot 101-1 and the second slot 101-2 on the housing 101. The first latch 301-1 and the second latch 301-2 are simultaneously pressed to allow the catapult 300 to be pulled out of the housing 101 (FIG. 1). The first thrust spring 402 and the second thrust spring 403 are compressed and fixed by the first locating hole 401-1 and the second locating hole 401-2 of the ejection switch 401 that is on the ejection switch mechanism 400 to the first locating column 101-4 and the second locating column 101-5 that are both on the housing 101. The laser sight 202 and the battery 203 of the laser aiming mechanism 200 pass through the circuit board 205 and are fixed into the slide switch 201 (FIGS. 2A-2B). The laser sight 201 and the battery 203 pass through the circuit board 205 and are fixed into the slide switch 201 (FIG. 3B).

Figure 4A:
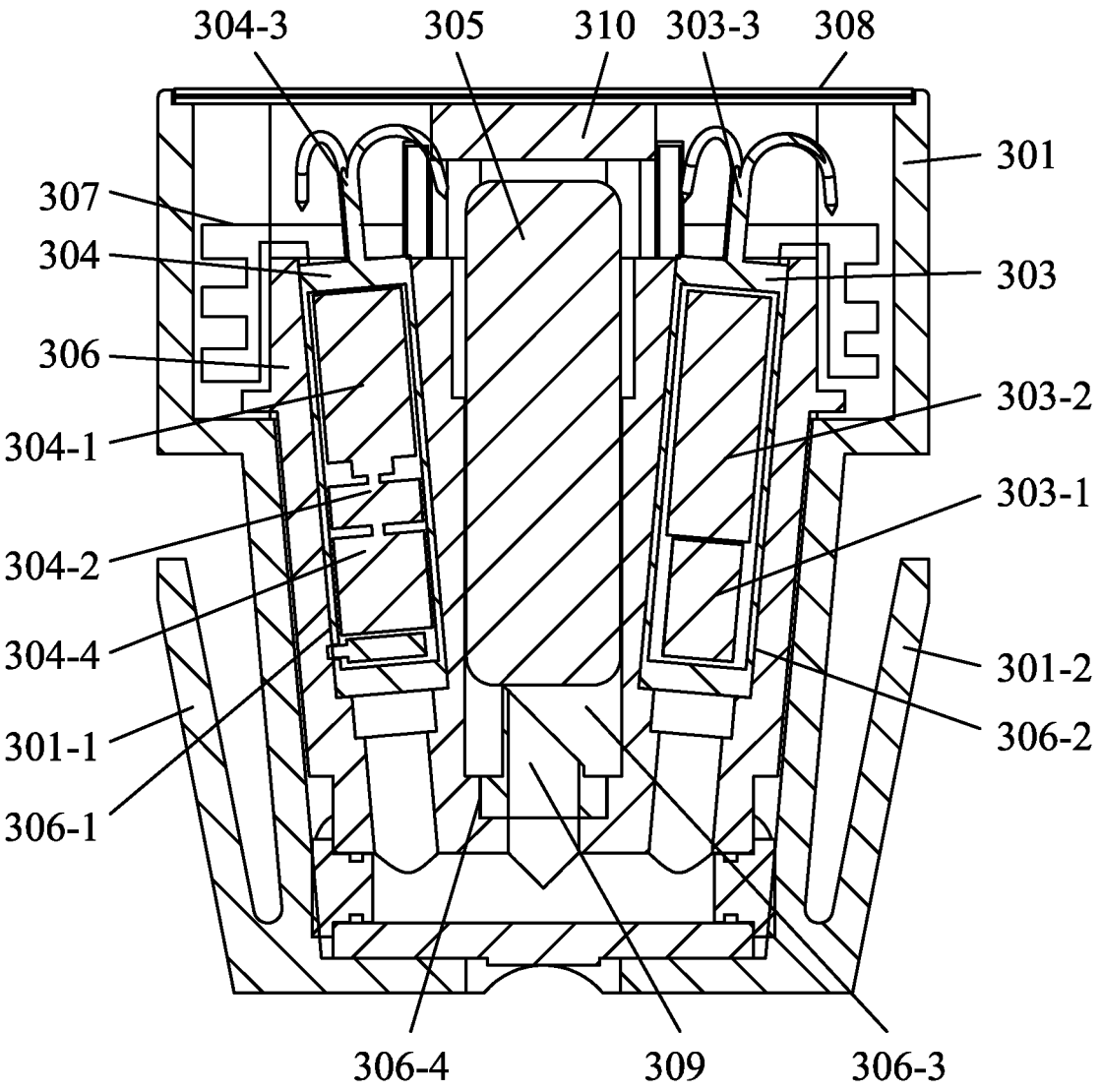
FIG. 4A is a cross-sectional view of a catapult of a conducted electrical weapon as described in the disclosure.
Figure 4B:
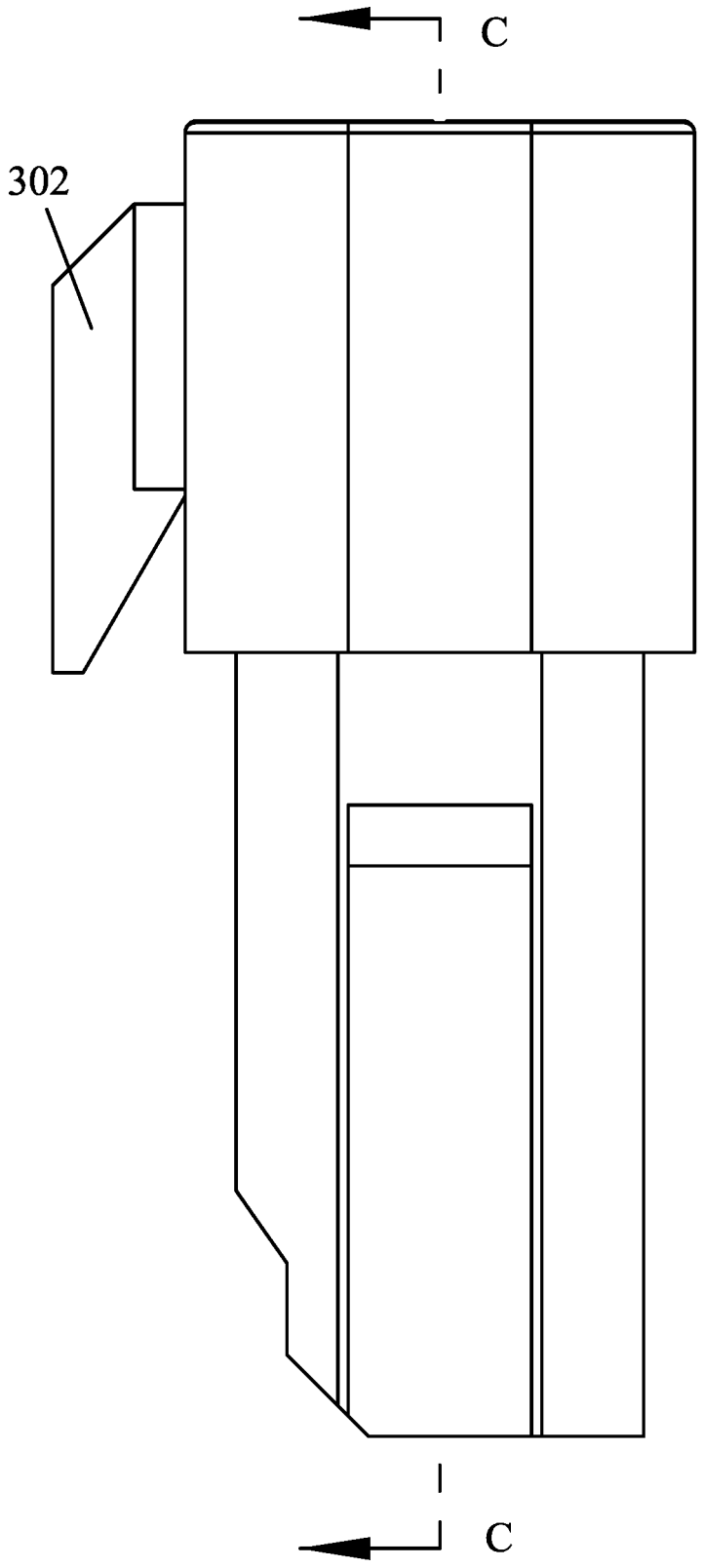
FIG. 4B is a left view of a catapult of a conducted electrical weapon as described in the disclosure.
Figure 4C:
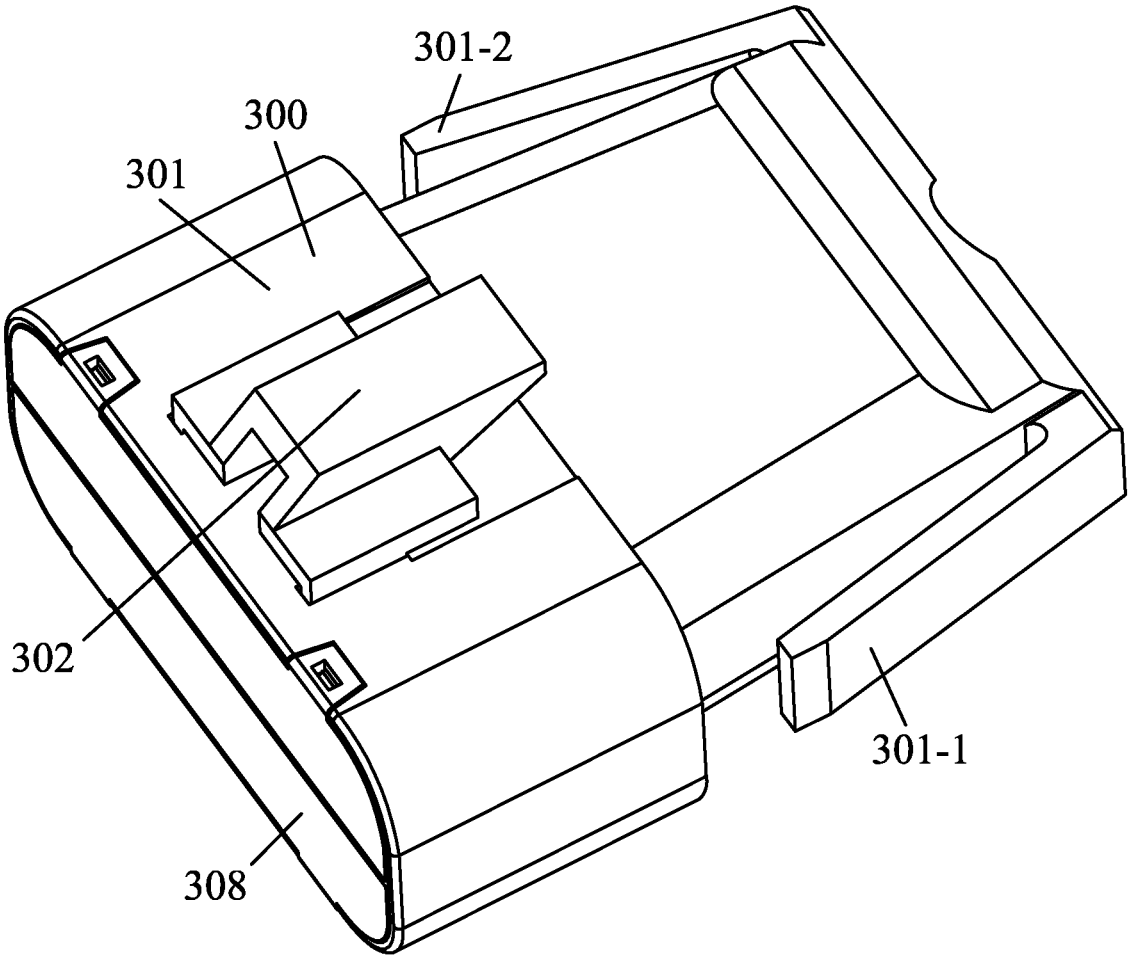
FIG. 4C is a perspective view of a catapult of a conducted electrical weapon as described in the disclosure.

The first high-voltage electric crochet 303, the second high-voltage electric crochet 304, the cylinder 305 with compressed gas and the needle 309, are separately mounted in the first fixed area 306-2, the second fixed area 306-1, the third fixed area 306-3 and the fourth fixed area 306-4 of the ballistic body 306. The elastic clip 301 is pressed by the press block 310 of elastic clip, and the ballistic body 306 is locked by the safety switch 302 of the elastic clip and blocked by the door 308 of the elastic clip (FIG. 4A).

The wire 307 electrically connects the high-voltage electric crochet 303 and the second high-voltage electric crochet 304 to conduct and bind the target person. The components responsible for high-voltage discharge comprises the battery 304-1, the control module 304-2, the boosting coil 304-4, the wire 307, the rectifying plate 303-1, the storage capacitor 303-2, the first crochet 303-3 and the second crochet 304-3 (FIG. 4A).

The conducted electrical weapon 100 carrying bundle function comprises a high-voltage electric crochet 303 and a second high-voltage electric crochet 304, and a wire 307 is connected between the two to conduct and bind the target person. The part responsible for high-voltage discharge comprises the battery 304-1, the control module 304-2, the boosting coil 304-4, the wire 307, the rectifying plate 303-1, the storage capacitor 303-2, the first crochet 303-3 and the second crochet 304-3. When the conducted electrical weapon ejects and binds the target, it forms a high-voltage discharge circuit with the bundled target (FIG. 4A).

The cylinder 305 with the compressed gas, the needle 309, the first high-voltage crochet 303, and the second high-voltage crochet 304 are all fixed by the ballistic body 306. After being assembled, the whole elastic clip 301 is assembled into the catapult 300, where the first high-voltage electric crochet 303 and the second high-voltage electric crochet 304 are assembled and fixed at an angle of 10 degrees to each other (FIG. 4A). The catapult 300 is embedded in the housing 101, until the first latch 301-1 and the second latch 301-2 of the elastic clip 301 catch the first slot 101-1 and the second slot 101-2 on the housing 101; at this point it is an integrated state of the conducted electrical weapon 100 with a binding function (FIG. 3B).

Figure 5A:
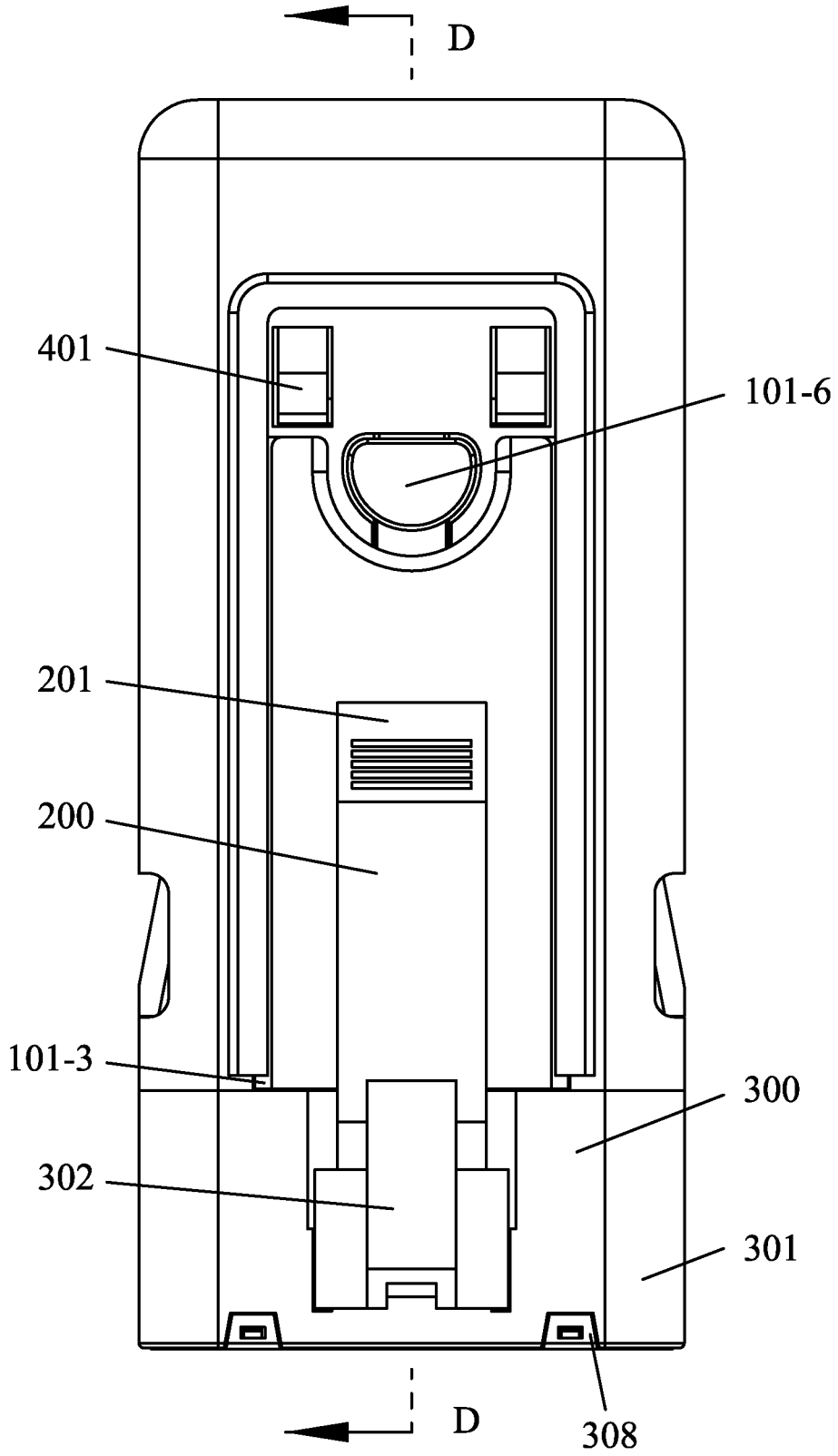
FIG. 5A is a top view of a conducted electrical weapon as described in the disclosure.
Figure 5B:
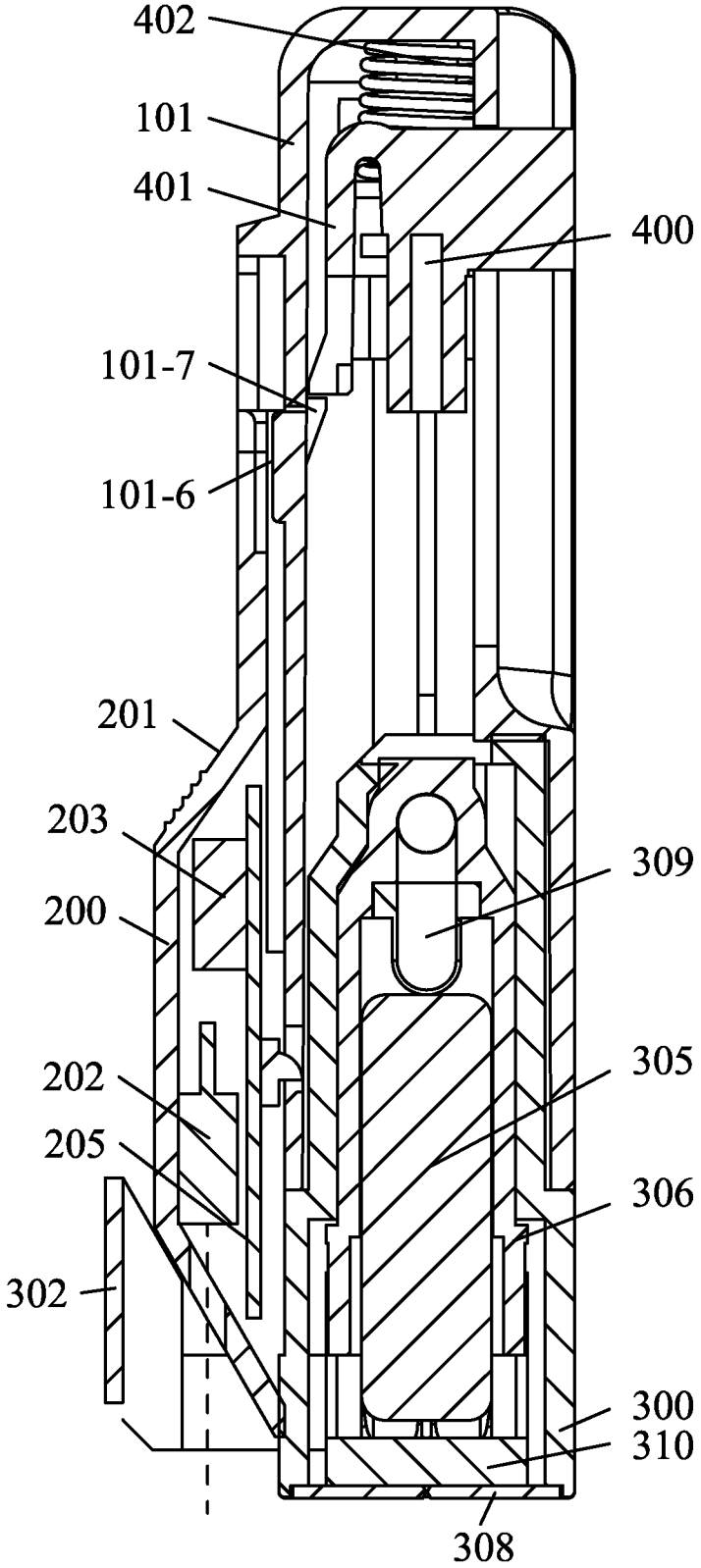
FIG. 5B is a cross-sectional view of a conducted electrical weapon as described in the disclosure.
Figure 5C:
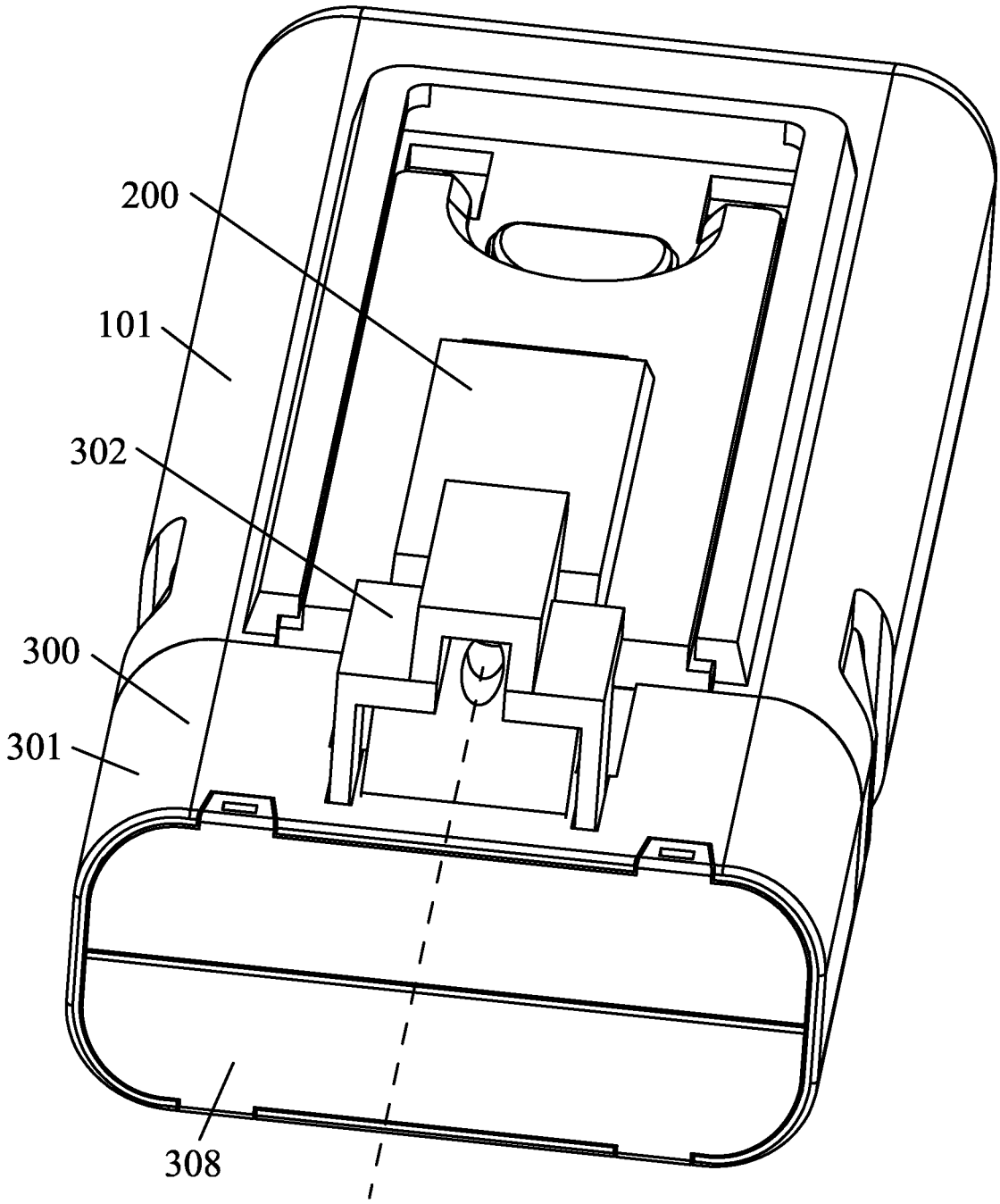
FIG. 5C is a perspective view of a conducted electrical weapon as described in the disclosure.

Pulling the ejection switch 401 to the opposite direction of the catapult 300 until the detent 101-7 of the housing 101 gets stuck (FIGS. 5A-5B). When the slide switch 201 moves toward the catapult 300 and pushes away the safety switch 302, the ballistic body 306 is unlocked, and the laser sight 202 generates a laser spot pointing to the target; at this time, the launch switch 101-6 hidden under the slide switch 201 is exposed, the conducted electrical weapon carrying bundle function is in a state to be launched (FIG. 5B).

The principle of ejection and binding of the catapult are as follows:

Pressing the launch switch 101-6, after the ejection switch 401 leaves the detent 101-7, the first thrust spring 402 and the second thrust spring 403 immediately release the pressure to quickly push the ejection switch 401 moving toward the direction in which the catapult 300 is located. Then the first fixed area 306-1 of the ballistic body 306 is stuck, moving the entire ballistic body 306 in the direction in which the press block 310 of elastic clip is located. Because the cylinder 305 is blocked by the press block 310 of elastic clip, the cylinder 305 is pierced by the needle 309 under the pressing force of the ballistic body 306. The compressed gas in the cylinder 305 is instantaneously released to generate high-pressure gas, so that the first high-voltage electric crochet 303 and the second high-voltage electric crochet 304 thrust and hit the door 308 of the elastic clip open. The wire 307 is ejected together with the catapult 300 toward the target. Since the first high-voltage electric crochet 303 and the second high-voltage electric crochet 304 are fixed at an angle of 10 degrees to each other, the distance of the two electric crochets is increased in the process of shooting toward the target. After the wire 307 hits the target, it will drag the first high-voltage electric crochet 303 and the second high-voltage electric crochet 304. The first high-voltage electric crochet 303 and the second high-voltage electric crochet 304 are rotated in opposite directions around the target under the action of inertial motion until the wire 307 is tightened. When the first crochet 303-3 and the second crochet 304-3 are hooked to the target, the purpose of binding to the target is achieved.

The principle of electric shock of the conducted electrical weapon is as follows: when the first high-voltage electric crochet 303, the second high-voltage electric crochet 304 and the wire 307 are ejected from the catapult 300, the built-in switch starts working. The first high-voltage electric crochet 303 and the second high-voltage electric crochet 304 are connected by a wire 307, a high voltage is generated between the first crochet 303-3 and the second crochet 304-3; after hooking the target, a high-voltage discharge circuit is immediately formed, and finally the purpose of binding target and discharging the high-voltage pulse current is achieved.

It will be obvious to those skilled in the art that changes and modifications may be made, and therefore, the aim in the appended claims is to cover all such changes and modifications.

What is claimed is:

1. A conducted electrical weapon, comprising:

a housing comprising a chute;

a laser aiming mechanism;

a catapult; and an ejection switch mechanism;

wherein:

the laser aiming mechanism is fixed on the chute of the housing;

the catapult is embedded in the housing and the ejection switch mechanism is mounted inside the housing;

the catapult comprises an elastic clip comprising a first latch and a second latch; the housing comprises a first slot and a second slot; the first latch and the second latch of the elastic clip separately catch the first slot and the second slot of the housing;

the ejection switch mechanism comprises an ejection switch comprising a first locating hole and a second locating hole, a first thrust spring, and a second thrust spring; the housing further comprises a first locating column and a second locating column; the first thrust spring and the second thrust spring are butted against the first locating hole and the second locating hole and fixed on the first locating column and the second locating column, respectively; and the laser aiming mechanism comprises a slide switch, a laser sight, a battery, and a circuit board; the laser sight and the battery are disposed on the circuit board and are fixed in the slide switch via screws.

2. The gun of claim 1, wherein the catapult comprises a first electric crochet, a second electric crochet, a cylinder with compressed gas, and a needle, and a ballistic body, a safety switch, a press block, and a door; the ballistic body comprises a first fixed area, a second fixed area, a third fixed area and a fourth fixed area; the first electric crochet, the second electric crochet, the cylinder, and the needle are separately mounted in the first fixed area, the second fixed area, the third fixed area and the fourth fixed area of the ballistic body; the elastic clip is pressed by the press block, and the ballistic body is locked by the safety switch and blocked by the door.

3. The gun of claim 2, wherein wire is disposed between the first electric crochet and the second electric crochet; the high-voltage discharge is implemented by the battery, a control module, a boosting coil, the wire, a rectifying plate, a storage capacitor, a first crochet and a second crochet.

4. The gun of claim 1, wherein the cylinder with compressed gas, the needle, the first high-voltage crochet, and the second high-voltage crochet are fixed by the ballistic body; the elastic clip is loaded to the ballistic body to form the catapult; and an included angle of the first electric crochet and the second electric crochet is 10 degrees.

5. The gun of claim 2, wherein the cylinder with compressed gas, the needle, the first high-voltage crochet, and the second high-voltage crochet are fixed by the ballistic body; the elastic clip is loaded to the ballistic body to form the catapult; and an included angle of the first electric crochet and the second electric crochet is 10 degrees.

* * * * *